United States Patent [19]

Kotsakis

[11] 3,939,739

[45] Feb. 24, 1976

[54] ADJUSTABLE RATCHET WRENCH

[75] Inventor: Mike D. Kotsakis, Des Plaines, Ill.

[73] Assignee: Imperial-Eastman Corporation, Chicago, Ill.

[22] Filed: June 3, 1974

[21] Appl. No.: 475,975

[52] U.S. Cl. ..... 81/91 R; 81/138

[51] Int. Cl.[2] ..... B25B 13/28; B25B 13/14

[58] Field of Search ..... 81/91 R, 91 A, 138

[56] References Cited

UNITED STATES PATENTS

| | | | |
|---|---|---|---|
| 1,386,136 | 8/1921 | Sibbald | 81/91 R X |
| 1,808,001 | 6/1931 | Melin | 81/138 X |
| 2,800,045 | 7/1957 | Mann | 81/91 R |

*Primary Examiner*—Al Lawrence Smith
*Assistant Examiner*—James G. Smith
*Attorney, Agent, or Firm*—Wegner, Stellman, McCord, Wiles & Wood

[57] ABSTRACT

An adjustable ratchet wrench adapted for one-hand manipulation in originally engaging an element to be turned, and subsequently effecting a ratchet action in turning the element wherein the jaws of the wrench are caused to grip the element when the wrench is swung in a first direction and release the element when the wrench is swung in the opposite direction. The mechanism for adjusting the jaws is further arranged to prevent overtightening of the jaws which could otherwise prevent the desired ratcheting action in the subsequent turning of the element. The jaw adjusting mechanism includes a ratchet and manual operating structure permitting free movement of the jaws to the element-engaging disposition and subsequent releasable locking of the jaws in such disposition to provide the improved ratcheting action in turning the element.

7 Claims, 8 Drawing Figures

ADJUSTABLE RATCHET WRENCH

BACKGROUND OF THE INVENTION

This invention relates to ratchet wrenches and in particular to adjustable ratchet wrenches.

DESCRIPTION OF THE PRIOR ART

In U.S. Pat. No. 2,800,045, of Morley Mann, owned by the assignee hereof, a wrench having pivotable and relatively adjustable jaws is disclosed for use in turning polygonal work elements, such as nuts. The wrench is provided with a knurled element which is manipulated to vary the size of the work-receiving gap formed by the inner and outer jaws of the wrench to accommodate the wrench to different size nuts. The jaws are pivotally mounted to swing between an open position wherein the nut may be brought laterally about the nut to be turned and a closed position wherein the jaws engage the nut for subsequent turning of the nut in a ratchet-type operation wherein the jaws grip the nut when the wrench handle is swung in a first direction and slip over the nut when the wrench handle is swung in the opposite direction.

Spring means are provided to bias the jaws both to the open arrangement and the closed nut-engaging arrangement so that in the ratcheting action, the jaws are repeatedly brought into the nut-engaging disposition for incremental turning of the nut.

The wrench is further adapted for use with pipe elements in a modified form wherein the jaws are provided with serrated work-engaging surfaces.

Additional U.S. Letters Patent which are pertinent to such wrench structures are those of Quinley, U.S. Pat No. 915,699; Sibbald, U.S. Pat. No. 1,386,136; Logan, U.S. Pat. No. 1,573,722; and Mann U.S. Pat. No. 2,708,384.

SUMMARY OF THE INVENTION

The present invention comprehends a ratchet wrench providing further improved functioning in facilitating the turning of the work element.

In the illustrated embodiment, the jaws of the wrench are arranged to be widely spaced to permit engagement of the work element therebetween by an improved movable arrangement of the outer jaw. Thus, in the illustrated embodiment, the outer jaw is pivotally mounted to a carrier which, in turn, is movably mounted to the handle to permit selective spacing of the outer jaw from the inner jaw. The carrier is biased to a position of maximum spacing between the jaws by a suitable spring. The carrier is releasably locked in any one of a plurality of adjusting positions by a manually releasable ratchet means. In the illustrated embodiment, the ratchet means includes a ratchet wheel rotatably carried on the handle and having teeth engageable with ratchet teeth on the carrier for locking the carrier in the different preselected positions. The ratchet wheel is biased by a suitable spring to effect the locking operation and manual operating means are provided for releasing the engagement between the ratchet wheel teeth and the carrier teeth to permit free movement of the carrier relative to the handle when desired.

Movement of the carrier in opposition to the spring biasing means is effected by engagement by the user's thumb with a suitable manipulating portion of the carrier. In the illustrated embodiment, the manipulating portion comprises a separate thumbpiece pivotally mounted to the handle and articulated to the carrier for effecting the manual movement thereof.

The invention comprehends an improved arrangement of the wrench structure which automatically assures proper engagement of the wrench jaws with the work element to provide the desired ratcheting action upon subsequent reciprocable swinging of the wrench handle. More specifically, the inner jaw and handle are provided with cooperating stop means for limiting the pivotal movement of the inner jaw on the handle to a preselected maximum pivotal position. The inner jaw is brought to this maximum position by a corresponding inward manipulation of the carrier by the user. The pivoting of the inner jaw is effected by the urging of the outer jaw into a slightly overtightened condition. The ratchet means for controlling the carrier position permits the carrier then to move outwardly a preselected small amount to reposition the jaws substantially in the unpivoted position for subsequent ratchet operation in turning of the work element. The location of the stop means is correlated with the pitch and depth of the ratchet teeth to effect this desired repositioning automatically over the entire range of sizes of accommodated workpieces between the maximum and minimum corresponding to the maximum spaced and minimum spaced dispositions of the jaws.

The adjustable ratchet wrench of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5, 6, 7, 8:
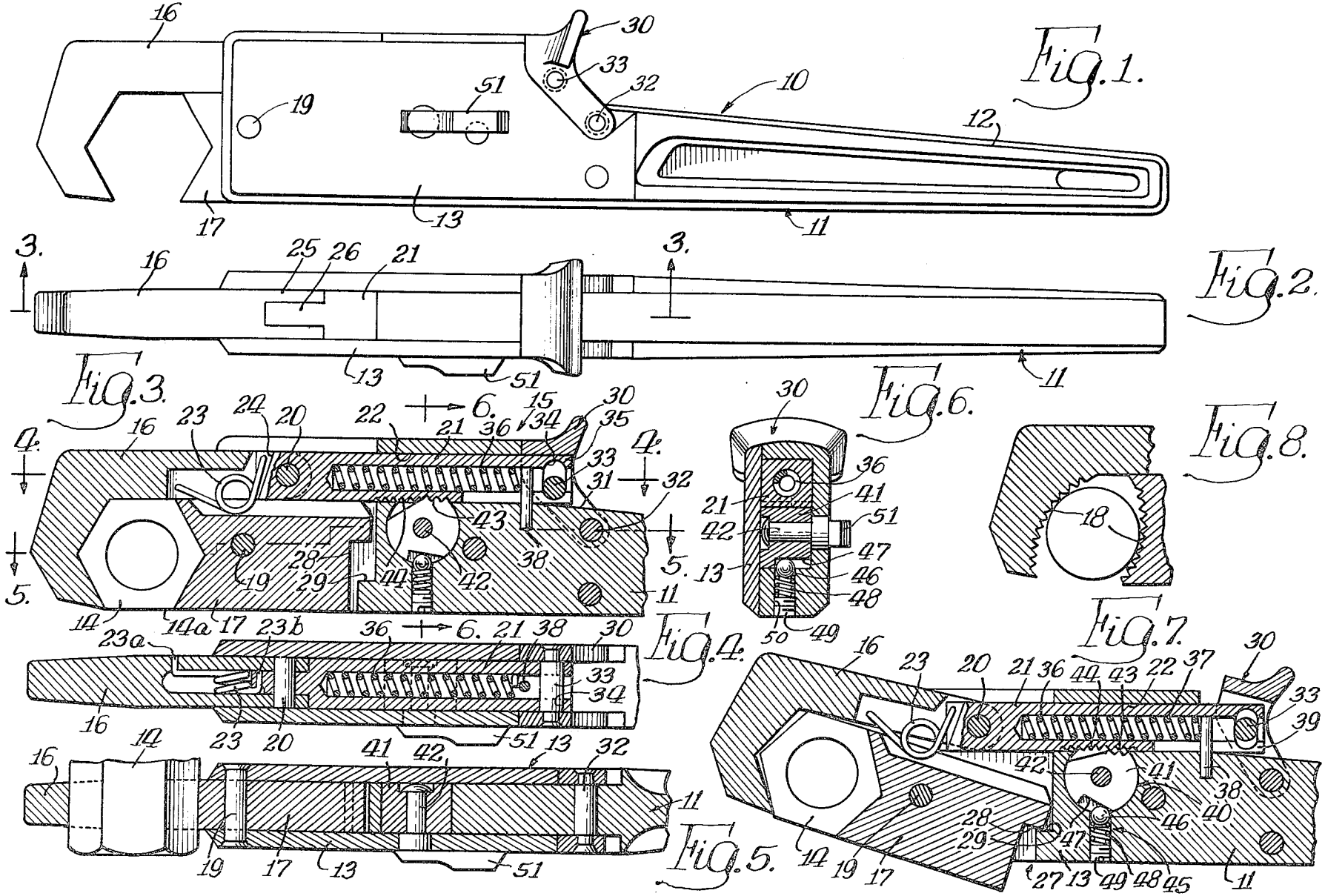
FIG. 1 is a side elevation of an adjustable ratchet wrench embodying the invention.
FIG. 2 is a top plan view thereof.
FIG. 3 is a fragmentary longitudinal section taken substantially along the line 3—3 of FIG. 2.
FIG. 4 is a fragmentary section taken substantially along the line 4—4 of FIG. 3.
FIG. 5 is a fragmentary section taken substantially along the line 5—5 of FIG. 3.
FIG. 6 is a fragmentary transverse section taken substantially along the line 6—6 of FIG. 3.
FIG. 7 is a fragmentary longitudinal section similar to that of FIG. 3 but with the jaws arranged in the initial work element-engaging disposition.
FIG. 8 is a fragmentary side elevation illustrating a modified form of jaws for use therein.

In the exemplary embodiment of the invention as disclosed in the drawing, an adjustable ratchet wrench generally designated 10 is shown to comprise a handle 11 having a manual gripping portion 12 and a jaw mounting portion 13. The wrench is adapted for use in turning work elements, such as nut 14, with a ratchet-type action and is provided with improved means generally designated 15 for mounting an outer jaw 16 and an inner jaw 17 to the handle 11 suitably to effect such turning. As will be obvious to those skilled in the art, the jaws may be provided alternatively with serrated surfaces 18 for use in turning a pipe element or the like, as shown in FIG. 8. Any suitable work engaging configuration of the jaws may be utilized within the scope of the invention.

In providing the ratchet-type turning of the work element, the jaws are carried by mounting means 15 to grip the work element therebetween as an incident of the handle 11 being swung in a gripping direction (which, in the illustrated embodiment of FIG. 3, would be in a clockwise direction about the work element 14) and to release the work element therebetween as an incident of the handle being reversely swung. Thus, during each incremental gripping and release of the work element, the work element may be turned to be engaged by the jaws on the repositioned flatted surface to effect the successive incremental ratchet-type turning of the work element. This ratchet-type action is effected by the pivotal mounting of the inner jaw 17 on a suitable pivot 19 to the handle portion 13 and the pivotal mounting of the outer jaw 16 by a suitable pivot 20 to a carrier 21 longitudinally slidably received in a bore 22 of the handle portion 13, as shown in FIGS. 3 and 7. The jaws are biased to the work gripping position of FIG. 3 by a suitable coil spring 23 having one end 23*a* secured to jaw 16 and the opposite end 23*b* abutting a retaining surface 24 of the carrier 21. As shown in FIG. 2, outer jaw 16 includes a bifurcated inner end 25 which straddles an outwardly extending projection 26 on carrier 21.

The axes of pivots 19 and 20 are disposed in spaced parallel relationship so that rearward, or inner, movement of the pivot pin 20 from the position of FIG. 3 to the position of FIG. 7 causes the jaws 16 and 17 to pivot in a clockwise direction whereby a small amount of over-travel of the carrier inwardly in adjusting the jaws to the workpiece is provided. The maximum amount of such over-travel, however, is limited by a stop means generally designated 27 including a stop shoulder 28 on jaw 17 and a complementary stop shoulder 29 on handle portion 13.

Inward movement (to the right as seen in FIGS. 3 and 4) of the carrier is effected by manipulation of a thumbpiece 30 having a connecting portion 31 pivotally mounted to handle 11 on a pivot pin 32. The thumbpiece includes a connecting pin 33 received in a slot 34 in the inner end 35 of the carrier 21 whereby clockwise rotation of the thumbpiece effects a right-hand movement of the carrier as illustrated in FIG. 7. The carrier is biased outwardly (leftwardly as seen in FIG. 7) by a coil spring 36 received in an inwardly opening longitudinal recess 37 in carrier 21 and compressed against a retainer pin 38 carried by the handle and projecting into recess 37 through a suitable slot 39. Thus, upon release of the thumbpiece 30, spring 36 urges the carrier 21 outwardly to the position of FIG. 3, and concurrently swings the jaws 16 and 17 into an aligned relationship of the longitudinal extent of handle 11.

The outward movement of the carrier is controlled by a ratchet control generally designated 40. In the illustrated embodiment, ratchet control 40 includes a ratchet wheel 41 pivotally mounted to handle 11 on a pivot 42 and having teeth 43 selectively engageable with complementary ratchet teeth 44 on the confronting lower surface of the carrier 21. Ratchet wheel 41 is biased in a counterclockwise direction to urge teeth 43 into engagement with carrier teeth 44 by suitable biasing means generally designated 45 including a ball 46 engaging a chordal surface 47 on ratchet wheel 41 and a coil spring 48 compressed between ball 46 and an adjusting screw 49 threaded to the handle 11 in a recess 50 therein.

The pitch of the teeth 43 and 44 and the depth of the teeth 43 and 44 are preselected so as to permit pivotal movement of jaw 17 back from the stopped disposition of FIG. 7 to the jaw-aligned disposition of FIG. 3 before the carrier is locked by the interengagement between teeth 43 and 44 resulting from a slight outward movement of the carrier from the position of FIG. 7 to the position of FIG. 3.

With the spacing of the jaws thusly maintained by the locking of the carrier in the adjusted preselected position determined by the locking engagement between the ratchet wheel 41 and ratchet teeth 44, the subsequent sequential downward and upward swinging of the handle 11 effects a ratcheting action in turning the work element 14 wherein the jaws 16 and 17 slide over the work element surfaces by pivoting to a slightly separated position from the work gripping position of FIG. 3 during the upward work-element releasing movement of the handle. The incremental turning of the work element may be continued as desired and upon completion thereof, the wrench may be disengaged from the work element by suitable release of the ratchet locking means 40. For this purpose, a manual release button 51 is provided on the side of handle portion 13 and connected to the ratchet pivot 42 as shown in FIG. 5, to permit reverse, or clockwise, rotation of the ratchet wheel 41 suitably to disengage teeth 43 from teeth 44 and permit carrier spring 36 to space jaw 16 outwardly suitably to release the jaws from the work element.

In the illustrated embodiment, the correlation of stop means 27 with the locking ratchet control 40 permits a locking of the carrier in all positions between the maximum and minimum spacing of jaws 16 and 17 so as to provide an infinitely universal adjustable ratchet wrench structure. As will be obvious to those skilled in the art, if less than a universal provision is desired, suitable repositioning of stop shoulder 29 or suitable alteration in the pitch or depth of the teeth 43 and 44 may be effected as desired.

In use, wrench 10 permits a facilitated engagement of the jaws 16 and 17 with the work element permitting the engagement to be effected by only one hand of the user engaging the handle 11 with the jaws originally released to the maximum spaced condition whereby the workpiece may be brought into the space between the jaws by a simple downward movement of the jaws thereabout. Thumbpiece 30 is then urged rearwardly by the user pressing rearwardly thereagainst with his thumb while maintaining his grasp on handle 11 so as to bring the jaws to the slightly over-tightened condition of FIG. 7 which condition is automatically indicated to the user by the abutment of jaw 17 with stop shoulder 29. Release of the thumbpiece 30 then automatically permits carrier spring 36 to reposition the carrier under the control of the ratchet cam structure 40 a small amount whereby the jaws are brought substantially back to the aligned position of FIG. 3 wherein a subsequent ratchet action turning of the work element may be effected by the sequential downward and upward swinging of handle 11.

The provision of the stop means 27 assures that the jaws 16 and 17 will not be swung to an over-adjusted position wherein they will not release the work element upon a reverse, or upward, swinging of the handle and, thus, assures that the desired automatic ratcheting action will be provided with the work element 14 comprising any one of an infinite plurality of different size work elements between the minimum and maximum sizes accommodated by the jaws.

The foregoing disclosure of specific embodiments is illustrative of the broad inventive concepts comprehended by the invention.

I claim:

1. In an adjustable ratchet wrench having a handle, a first jaw, means for pivotally mounting said jaw to the handle, a second jaw, a carrier, means for pivotally mounting said second jaw to said carrier, means for movably mounting the carrier to the handle for variably spacing the second jaw relative to the first jaw permitting the jaws to be disposed in a gripping position wherein they grip therebetween an element to be turned as an incident of the handle being swung in a gripping direction and move in a release direction to a release position wherein they release the element therebetween as an incident of the handle being reversely swung thereby to provide a ratcheting of the element, the improvement comprising stop means on the handle for limiting pivotal jaw release movement of said first jaw to maintain the ratcheting arrangement of the jaws, said means for movably mounting the carrier to the handle comprising one-way ratchet means for adjustably spacing said second jaw relative to said first jaw in any one of a plurality of preselected discrete positions, and further including manually operable means for urging said second jaw to an element-engaging adjusted position in the direction of free movement of the ratchet means, whereby said ratchet means retains the said second jaw in the adjusted element-engaging position for selective gripping and release of the element as an incident of said swinging of the handle, manually operable release means for releasing the ratchet means to permit free adjustable increased spacing of said second jaw relative to the first jaw, and means biasing said second jaw toward a retracted maximumspaced position whereby said second jaw is moved to said retracted position upon release of the ratchet means.

2. An adjustable ratchet wrench comprising: a handle; a pair of jaws; pivot means for individually movably mounting the jaws for movement to a gripping position wherein they grip therebetween an element to be turned as an incident of the handle being swung in a gripping direction and to a release position wherein they release the element therebetween as an incident of the handle being reversely swung thereby to provide a ratcheting of the element; means for adjusting the jaw spacing for gripping any one of a plurality of different size elements including a carrier movably mounted to said handle, a first one of said pivot means pivotally mounting one jaw to said carrier, and a second one of said pivot means pivotally mounting the other jaw to said handle; and means for selectively positioning said carrier in any one of a plurality of preselected discrete positions on said handle, said selectively positioning means comprising a lockable ratchet and manually operable means for selectively releasing the ratchet to permit free adjustable spacing of said one jaw relative to the other, said positioning means further including resilient means biasing said carrier to provide maximum spacing of said jaws when said ratchet is released.

3. The adjustable ratchet wrench of claim 2 further including manually operable means for moving the carrier to a selected gripping position against the action of said biasing means, said ratchet releasably locking the carrier in said selected position.

4. In an adjustable ratchet wrench having a handle, a first jaw, means for pivotally mounting said jaw to the handle, a second jaw, a carrier, means for pivotally mounting said second jaw to said carrier, means for movably mounting the carrier to the handle for variably spacing the second jaw relative to the first jaw permitting the jaws to be disposed in a gripping position wherein they grip therebetween an element to be turned as an incident of the handle being swung in a gripping direction and move in a release direction to a release position wherein they release the element therebetween as an incident of the handle being reversely swung thereby to provide a ratcheting of the element, the improvement comprising stop means on the handle for limiting pivotal jaw release movement of said first jaw to maintain the ratcheting arrangement of the jaws, said means for movably mounting the carrier to the handle comprising a lockable ratchet and manually operable means for selectively releasing the ratchet to permit free adjustable spacing of said second jaw relative to the first jaw, said ratchet comprising ratchet teeth on said carrier, a ratchet wheel pivotally carried on the handle and having teeth engageable with said carrier ratchet teeth, resilient means biasing the ratchet wheel in a first direction to engage the teeth thereof with said carrier ratchet teeth and lock the carrier against movement on said handle, said manually operable releasing means comprising means for manually pivoting said ratchet wheel to disengage said ratchet wheel teeth from said carrier ratchet teeth.

5. In an adjustable ratchet wrench having a handle, a first jaw, means for pivotally mounting said jaw to the handle, a second jaw, a carrier, means for pivotally mounting said second jaw to said carrier, means for movably mounting the carrier to the handle for variably spacing the second jaw relative to the first jaw permitting the jaws to be disposed in a gripping position wherein they grip therebetween an element to be turned as an incident of the handle being swung in a gripping direction and move in a release direction to a release position wherein they release the element therebetween as an incident of the handle being reversely swung thereby to provide a ratcheting of the element, the improvement comprising stop means on the handle for limiting pivotal jaw release movement of said first jaw to maintain the ratcheting arrangement of the jaws, said selectively positioning means for movably mounting the carrier to the handle comprising a lockable ratchet and manually operable means for selectively releasing the ratchet to permit free adjustable spacing of said second jaw relative to the first jaw, said positioning means further including resilient means biasing said carrier to provide maximum spacing of said jaws when said ratchet is released, and manually operable means for moving the carrier to a selected gripping position against the action of said biasing means, said ratchet releasably locking the carrier in said selected position.

6. In an adjustable ratchet wrench having a handle, a first jaw, means for pivotally mounting said jaw to the handle, a second jaw, a carrier, means for pivotally mounting said second jaw to said carrier, means for movably mounting the carrier to the handle for variably spacing the second jaw relative to the first jaw permitting the jaws to be disposed in a gripping position wherein they grip therebetween an element to be turned as an incident of the handle being swung in a gripping direction and move in a release direction to a release position wherein they release the element therebetween as an incident of the handle being reversely swung thereby to provide a ratcheting of the element, the improvement comprising stop means on the handle for limiting pivotal jaw release movement of said first jaw to maintain the ratcheting arrangement of the jaws, said means for movably mounting the carrier to the handle comprising ratchet means for adjustably spacing said second jaw relative to said first jaw in any one of a plurality of preselected discrete positions, said ratchet means comprising ratchet teeth on said carrier, a ratchet wheel pivotally carried on the handle and having teeth engageable with said carrier ratchet teeth, resilient means biasing the ratchet wheel in a first direction to engage the teeth thereof with said carrier ratchet teeth and lock the carrier against movement on said handle, said manually operable releasing means comprising means for manually pivoting said ratchet wheel to disengage said ratchet wheel teeth from said carrier ratchet teeth, the depth of said teeth being preselected to permit rotation of the ratchet wheel sufficient to swing the teeth thereon at least one full pitch.

7. In an adjustable ratchet wrench having a handle, a first jaw, means for pivotally mounting said jaw to the handle, a second jaw, a carrier, means for pivotally mounting said second jaw to said carrier, means for movably mounting the carrier to the handle for variably spacing the second jaw relative to the first jaw permitting the jaws to be disposed in a gripping position wherein they grip therebetween an element to be turned as an incident of the handle being swung in a gripping direction and move in a release direction to a release position wherein they release the element therebetween as an incident of the handle being reversely swung thereby to provide a ratcheting of the element, the improvement comprising stop means on the handle for limiting pivotal jaw release movement of said first jaw to maintain the ratcheting arrangement of the jaws, said means for movably mounting the carrier to the handle comprising ratchet means for adjustably spacing said second jaw relative to said first jaw in any one of a plurality of preselected discrete positions, said ratchet means comprising ratchet teeth on said carrier, a ratchet wheel pivotally carried on the handle and having teeth engageable with said carrier ratchet teeth, resilient means biasing the ratchet wheel in a first direction to engage the teeth thereof with said carrier ratchet teeth and lock the carrier against movement on said handle, said manually operable releasing means comprising means for manually pivoting said ratchet wheel to disengage said ratchet wheel teeth from said carrier ratchet teeth, the depth of said teeth being preselected to permit rotation of the ratchet wheel sufficient to swing the teeth thereon at least one full pitch, the maximum pivoting of said second jaw permitted by said stop means corresponding to the movement of said carrier permitted by movement of the ratchet wheel teeth fully into the carrier ratchet plus one full pitch of said teeth.

* * * * *